United States Patent [19]

Pottier

[11] 4,284,923

[45] Aug. 18, 1981

[54] ION BEAM BUNCHER—DEBUNCHER

[75] Inventor: Jacques Pottier, Orsay, France

[73] Assignee: Commissariat a l'Energie Atomique, Paris, France

[21] Appl. No.: 93,217

[22] Filed: Nov. 13, 1979

[30] Foreign Application Priority Data

Nov. 23, 1978 [FR] France ..... 78 33103

[51] Int. Cl.[3] ..... H01J 23/20

[52] U.S. Cl. ..... 315/5.51; 315/5.37; 315/5.41; 315/5.52

[58] Field of Search ..... 315/5.41, 5.42, 5.51, 315/5.39, 5.52

[56] References Cited

U.S. PATENT DOCUMENTS

| | | | |
|---|---|---|---|
| 2,547,061 | 4/1951 | Touraton et al. | 315/5.41 |
| 2,770,755 | 11/1956 | Good | 315/5.42 |
| 2,880,353 | 3/1959 | Warnecke et al. | 315/5.41 X |
| 3,366,886 | 1/1968 | Dryden | 315/5.42 X |
| 3,387,171 | 6/1968 | Heil | 315/5.51 |
| 3,710,163 | 1/1973 | Bomko et al. | 315/5.41 |
| 3,819,977 | 6/1974 | Kageyama | 315/5.51 |

FOREIGN PATENT DOCUMENTS

| | | | |
|---|---|---|---|
| 503447 | 6/1954 | Canada | 315/5.51 |
| 178915 | 11/1968 | U.S.S.R. | 315/5.42 |
| 368673 | 9/1973 | U.S.S.R. | 315/5.51 |
| 197037 | 4/1975 | U.S.S.R. | 315/5.41 |

*Primary Examiner*—Saxfield Chatmon, Jr.

*Attorney, Agent, or Firm*—Pearne, Gordon, Sessions, McCoy & Granger

[57] ABSTRACT

Ion beam buncher—debuncher of the type having a resonant structure supplied by a high frequency or hyperfrequency generator, said structure comprising a cylindrical wall closed by two lateral faces respectively traversed by a supply pipe and a discharge pipe for the beam, together with a sliding tube arranged between the said pipes and defining with the supply pipe a first gap and with the discharge pipe a second gap, the ion beam being introduced into the said structure by the supply pipe firstly undergoing in the first gap a first action on the part of the electrical field therein, then traversing the sliding pipe and finally undergoing in the second gap a second action on the part of the electrical field therein and leaving the structure by the discharge pipe, wherein the two gaps defined by the sliding tube and the supply and discharge pipes are extremely asymmetrical, one of the two gaps offering the ion beam a much weaker electrical field than that offered by the other gap, so that the action exerted on the ions in said gap by the electrical field is negligible compared with that exerted in the other gap.

2 Claims, 9 Drawing Figures

ION BEAM BUNCHER—DEBUNCHER

BACKGROUND OF THE INVENTION

The present invention relates to an ion beam buncher - debuncher having asymmetrical gaps and operating in a wide velocity range. It is used in ion acceleration installations.

It is known that an ion beam buncher or debuncher is constituted by a resonant structure supplied by a high frequency or hyperfrequency source and traversed by an ion beam in such a way that the electrical field established in the structure modulates the velocity of the ions in an appropriate manner.

In a buncher, the velocity modulation has the effect of accelerating slow ions more than fast ions, which permits a rebunching in a bunch with a limited spatial extension at a given distance from the buncher. The velocities of the different ions constituting a bunch are then distributed in a wider range. Bunchers are used in ion acceleration systems when it is for example desired to carry out transit time experiments or any injection into a high frequency accelerator.

In a debuncher, the modulation has the effect of increasing the low velocities and decreasing the high velocities, making it possible to reduce the velocity dispersion of the ions. Such an apparatus is used when it is desired to employ monoergic ions and when no particular significance is attached to the width of the ion bunches.

FIGS. 1 and 2 give a general idea of the construction and operating principles of said two apparatuses.

In part (a) of FIG. 1 is shown a resonant structure constituted by a wall 2 closed at its two ends by lateral faces 4 and 6, respectively traversed by a supply pipe 8 and a discharge pipe 10 for an ion beam 12. The structure also comprises a sliding tube 14 connected to wall 2 by a conductive support 16. The sliding tube is separated from pipes 8 and 10 by two identical gaps $I_1$ and $I_2$, all the said members being conductive and for example of metal.

Part (b) of FIG. 1 illustrates the electrical diagram of the structure shown in part (a). The two pipes 8 and 10 are connected to earth (or more generally to a reference potential) and the sliding tube 14 is brought to an alternating current voltage V, due to the high frequency or hyperfrequency field in the structure (said voltage V being countered from the reference potential). Each of the gaps $I_1$ and $I_2$ has a length 1 and their centres are spaced by length L. A same average electrical field V/1 is therefore present in both these gaps.

The diagrams of FIG. 2 illustrate the operation of the device of FIG. 1. The average velocity ions enter the gap $I_1$ at time $t_o$ (part a), the distance z which they cover being plotted on the ordinate as a function of the times appearing on the abscissa. During their transit of gap $I_1$ these ions are subject (b) to an electrical field $E_o$, said field slightly modifying their velocity (this modification of velocity is generally small compared with the true velocity). Ions which are faster than those indicated hereinbefore reach gap $I_1$ at time $t_1$ prior to $t_o$. They are subject to the action of a field which is weaker than $E_o$. Conversely, the slower ions only reach gap $I_1$ at time $t_2 > t_o$ and the latter are subject to a stronger field $E_2$ than $E_o$. The relative magnitudes of the fields are therefore such that the slower ions are able to catch up the faster ions, this constituting buncher operation.

This mechanism naturally assumes that the electrical field increases in time in an appropriate manner. In practice, it is rate for the ideal linear modulation to be used, rather there is a sinusoidal modulation or a sum of sinusoidal modulations which are much easier to obtain, said modulation only being used for a substantially linear portion. The ions which penetrate the gap $I_1$ at periods where the field does not have the appropriate variations are clearly not rebunched. However, in the case of the others, there is a rebunching at a distance $z_o$ from gap $I_1$.

In an ion debuncher, the mechanism is the same, except that it tends to reduce the energy deficit of the slow ions and reduce the energy excess of the fast ions. A debuncher placed at a distance z receives the ions at time $t'_o$ and applies a field $E'_o$ to them. The faster ions have reached the interaction gap of the debuncher at time $t'_1$ prior to $t'_o$. They are subject to a field $E'_1$ which is weaker than $E'_o$. As for the slower ions, which reach the debuncher at $t'_1$, they are subject to a field $E'_2$ which is stronger than $E'_o$ in the interaction gap. On leaving the debuncher, the ions have a substantially identical velocity, but correlatively they occupy an extensive portion in space.

In both a buncher and a debuncher, the gaps where the ions are subject to the action of the electrical field must be sufficiently short for the transit time of the ions to be less than the half-cycle of the field. If v is the velocity of the ions and T the cycle, it is necessary to have $1/v < T/2$.

To explain this, it is pointed out that the voltages which are normally encountered in ion beam bunchers are defined by two requirements: the velocity modulation supplied to the beam must be low with respect to the velocity of the said beam and the accelerating voltage must be high with respect to the natural fluctuations of the beam. In practice, voltages of the order of a few dozen kilovolts or lower are used.

The voltages used in debunchers are of the same order of magnitude as the energy dispersion of the beam and can be between approximately 10 and approximately 100 kV.

In connection with said apparatuses, reference can be made to the article by E. L. HUBBARD et al entitled "Heavy ion linear accelerator", published in the Journal "The review of scientific instruments", Vol. 32, no. 6, June 1961, p.621 and the article by J. S. SOKOLOWSKI et al entitled "Status report on Stanford's superconducting heavy ion linear project", published in the Journal "IEEE Transactions on nuclear science", Vol. NS-24, No. 3, June 1977, p. 1141 and finally the article by B. CORK entitled "Proton linear accelerator injector for the Bevatron", and published in the Journal "The review of scientific instruments", Vol. 26, No. 2, February 1955, p. 210.

After describing these general points, it is possible to define the invention relative to the prior art. The structure shown in FIG. 1 is the closest prior art structure to that of the invention. It can be considered that it is formed by a first part constituted by tube 16, faces 4 and 6 and wall 2, said part being equivalent to a $\lambda/4$ resonant line, if $\lambda$ is the wavelength of the electromagnet field introduced into the structure and the second part constituted by gaps $I_1$ and $I_2$, which are zones having a capacitive nature.

The interest of such a structure is that it has small overall dimensions (less than $\lambda/4$), whilst the structures with a single interaction gap the dimensions are of the order of $\lambda/2$, which becomes prohibitive for working frequencies below 100 MHz (the half-wave length is then equal to 1.5 m).

This prior art structure makes it necessary for the actions exerted by the electrical field on the ions in the two interaction gaps to be of a cumulative nature. This implies that the ions transit the distance L separating these two gaps in a time which is an uneven multiple of the half-cycle T of the field. Thus, this prior art structure only functions correctly if the ions have a velocity close to 2L/T (or a multiply of this velocity.

This constraint made on the velocity of the ions is prejudicial in most applications of bunchers and debunchers. Thus, said apparatuses are generally used in installations comprising, for example and successively, an ion source, an injector, a first accelerator (for example of the Van der Graaf type) and a second accelerator (for example of the linear type). However, in such installations, it is often necessary to vary the energy of the ions, which involves modifying their velocity or changing from one type of ions to another with the energy constant, which also leads to a modification in their velocity.

It is not therefore possible to use the apparatuses described hereinbefore in all cases and their dimensions must be modified as a function of need, which is far from convenient.

Admittedly, devices are known having a single acceleration gap and which do not have the above disadvantage, due to the fact that there is only one gap. However, as has been stressed hereinbefore, these devices have the major disadvantage of large overall dimensions, which increase as the frequency decreases.

BRIEF SUMMARY OF THE INVENTION

The invention relates to a buncher—debuncher which simultaneously obviates the two above disadvantages. To this end, the buncher—debuncher according to the invention is of the type having two gaps and consequently has the advantage offered by such devices, namely limited overall dimensions. Moreover, the buncher—debuncher according to the invention does not have the disadvantage of a narrow velocity range due to the original arrangement of the two interaction gaps.

The buncher—debuncher according to the invention can therefore operate in a wide velocity range, whilst still having small overall dimensions.

This double objective is achieved by using two gaps which are not symmetrical as in the prior art and are instead very asymmetrical, one of them being the seat of an electrical field which is weak compared with the field in the other. Thus, the contribution of said gap in the velocity modulation process is negligible compared with that of the other gap. Thus, the condition relative to the cumulative nature of the two actions exerted by the field in the two gaps disappears and with it the constraint on the transit time of the ions from one gap to the other.

More specifically, the present invention relates to an ion beam buncher—debuncher of the type having a resonant structure supplied by a high frequency or hyperfrequency generator, said structure comprising a cylindrical wall closed by two lateral faces respectively traversed by a supply pipe and a discharge pipe for the beam, together with a sliding tube arranged between the said pipes and defining with the supply pipe a first gap and with the discharge pipe a second gap, the ion beam being introduced into the said structure by the supply pipe firstly undergoing in the first gap a first action on the part of the electrical field therein, then traversing the sliding pipe and finally undergoing in the second gap a second action on the part of the electrical field therein and leaving the structure by the discharge pipe, wherein the two gaps defined by the sliding tube and the supply and discharge pipes are extremely asymmetrical, one of the two gaps offering the ion beam a much weaker electrical field than that offered by the other gap, so that the action exerted on the ions in said gap by the electrical field is negligible compared with that exerted in the other gap.

According to first variant, in the buncher—debuncher according to the invention the weak action gap has a length such that it is traversed by the ion beam in a long period of time compared with the resonant half-cycle of the structure.

According to a second variant, in the buncher—debuncher according to the invention the supply and discharge pipes have different cross-sections, whilst the sliding tube has a flared shape passing from a small cross-section equal to that of one of the pipes to a large cross-section equal to that of the other pipe.

According to a third variant, the two above arrangements are combined.

BRIEF DESCRIPTION OF THE DRAWINGS

The invention will be described in greater detail hereinafter relative to non-limitative embodiments and with reference to the attached drawings, wherein show.

DETAILED DESCRIPTION OF THE PREFERRED EMBODIMENTS

Figure 1:
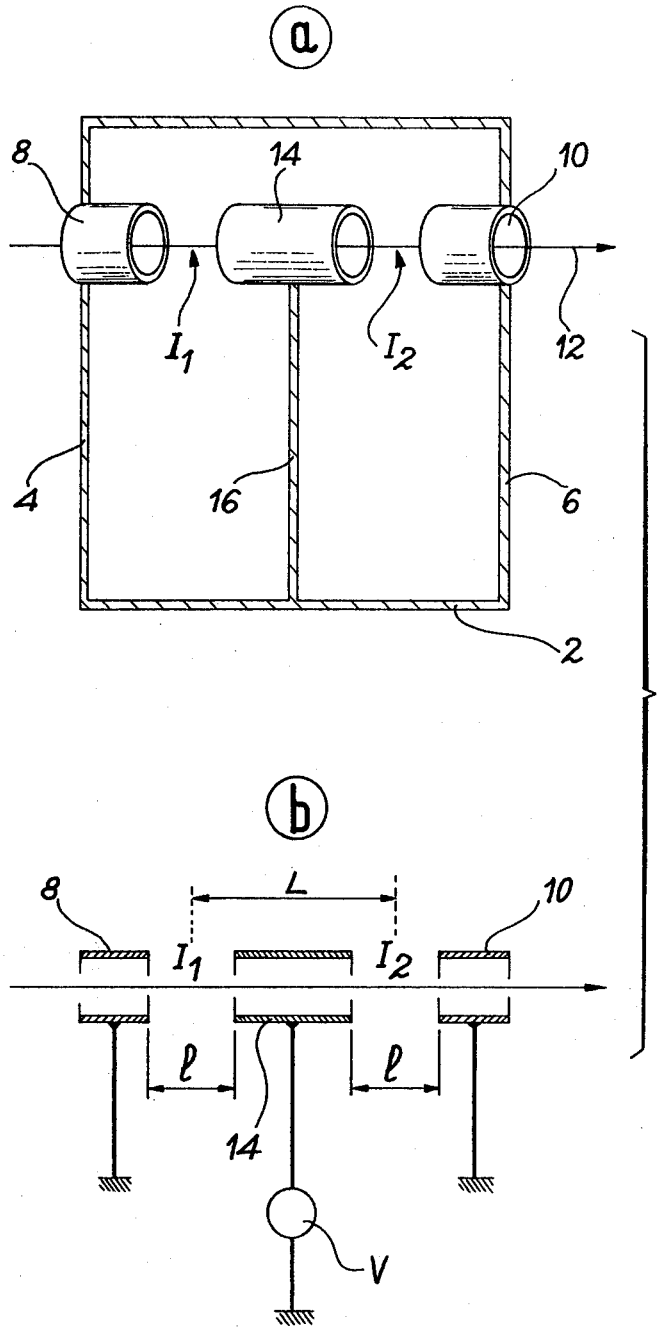
FIG. 1 (PRIOR ART)
FIG. 1 a prior art buncher—debuncher resonant structure.
Figure 2:
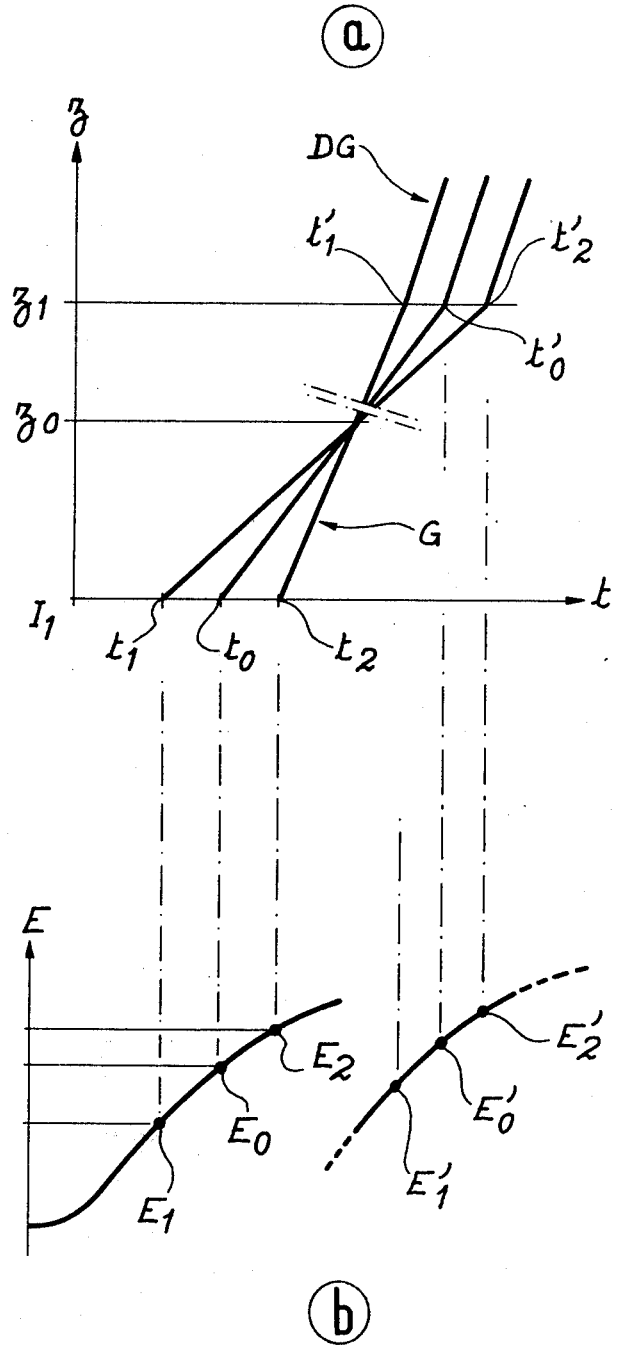
FIG. 2 an explanatory diagram of the operation of a buncher—debuncher.

FIGS. 1 and 2 relate to the prior art and have been described hereinbefore.

In the drawings relating to the present invention, it is assumed in illustrative manner that the first gap traversed by the ion beam is the gap with the preponderant action, whilst the second gap only has a negligible action. However, it is obvious that the order could be reversed, whereby the beam would first penetrate the gap having the negligible action. Moreover, in the following description, reference is only made to a "buncher", but it is obvious that the structures described can also operate as a debuncher.

Figure 3:
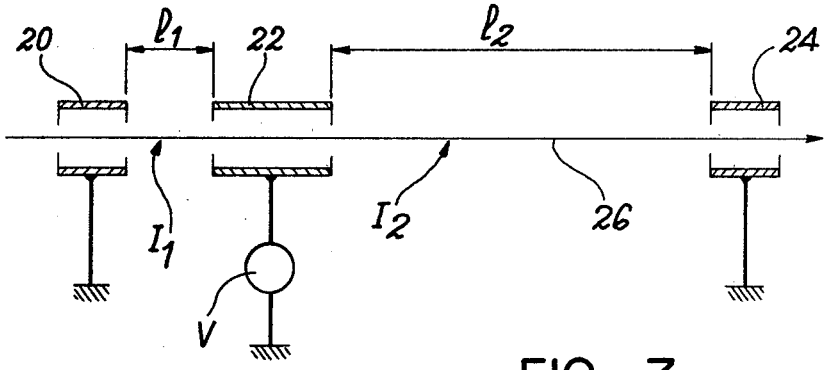
FIG. 3 an electrical diagram of a buncher—debuncher resonant structure according to a first variant of the invention.
Figure 4:
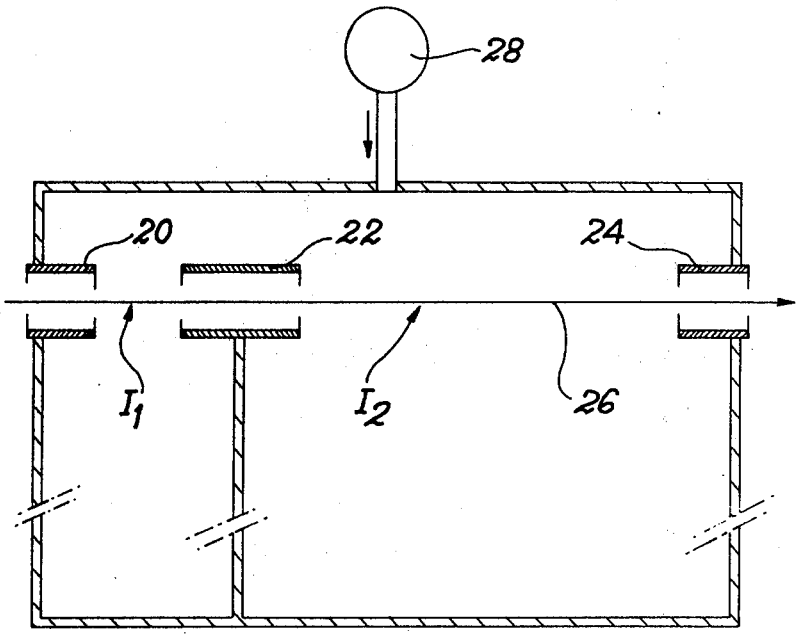
FIG. 4 in cross-section, a structure corresponding to said diagram.

FIGS. 3 and 4 firstly illustrate a first variant of the invention. In the diagram of FIG. 3, it is possible to see a supply pipe 20, a sliding tube 22 and finally a discharge pipe 24. An ion beam 26 successively traverses these three elements, which are respectively raised to potentials equal to O, V and O. The true structure is shown in FIG. 4. It is supplied by a high frequency or hyperfrequency source 28, the means for connecting this source to the resonant structure not being shown because they are well known to the Expert.

The supply pipe 20 and the sliding tube 22 define a first gap $I_1$ of length $\mathbf{1}_1$, which is the seat of an electric field of average value $V/\mathbf{1}_1$. The length $\mathbf{1}_1$ is chosen to be sufficiently short for the ion transit time to be less than the half-cycle T/2 of the field. Thus, as in the prior art, we obtain $\mathbf{1}_1 < Tv/2$. The sliding tube 22 and the discharge pipe 24 define a second gap $I_2$ of length $\mathbf{1}_2$, which is much larger than $\mathbf{1}_1$.

There are two consequences of this difference between the length $\mathbf{1}_1$ and $\mathbf{1}_2$, the first is that the average electrical field $V/\mathbf{1}_2$ in the second gap is much weaker than the average field $V/\mathbf{1}_1$ in the first gap and the second is that the length $\mathbf{1}_2$ is not smaller than Tv/2 as in $\mathbf{1}_1$, so that the ion transit time through said gap can reach or even exceed the cycle T of the field. The latter consequently changes direction during the transit in such a way that its action on the ions is very limited.

These two features of the field, namely weakness of its intensity and alternation during the ion transit, contribute to make its action negligible compared with that exerted in the first gap. Thus, in such a buncher the velocity of the ions is no longer subject to the condition mentioned hereinbefore relative to the prior art and which relates to the time taken by the ions to pass from one gap to the other, so that the time at which the ions penetrate the gap $I_1$ becomes unimportant.

Figure 5:
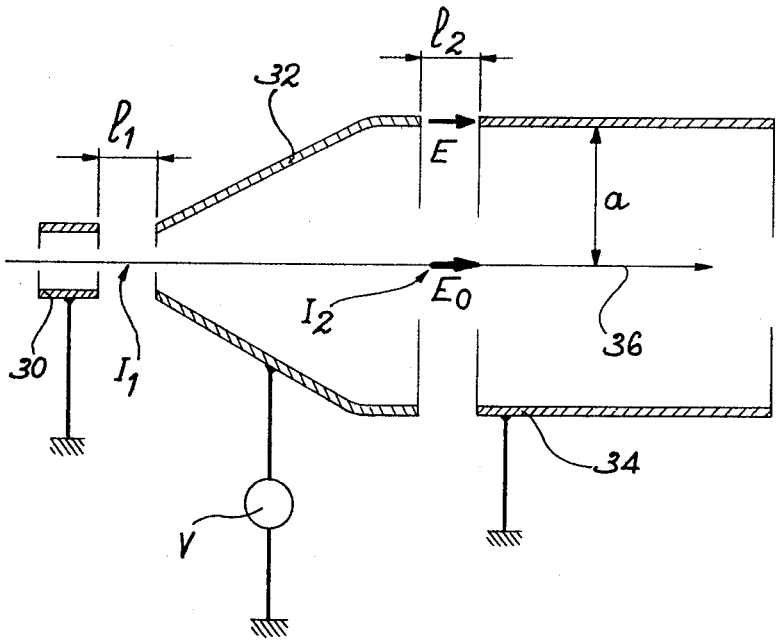
FIG. 5 diagrammatically, a buncher—debuncher resonant structure according to a second variant of the invention.

FIG. 5 illustrates a second variant of the invention. The device shown also comprises a supply pipe 30, a sliding tube 32 and a discharge pipe 34, but the latter has a larger cross-section than the supply pipe. The sliding tube has a flared shape which constitutes a transition between the supply and discharge pipes.

In the variants shown, the gaps $I_1$ and $I_2$ have the same length $\mathbf{1}_1=\mathbf{1}_2$. The average electrical field $V/\mathbf{1}_2$ between the sliding tube 32 and the discharge pipe 34 is therefore the same as that between the supply pipe 30 and the sliding tube 32. However, this relates to the field in a zone remote from that which is traversed by the ion beam. The field which acts on the ions differs from that level with the discharge pipe. If it is assumed that the structure revolves about the axis of the beam, field $E_o$ on said axis is linked with the field $E_a$ of radius a by the equations:

$$E_o=E_a/I_o\,(2\pi a)/\beta\lambda$$

in which $I_o$ is the modified Bessel function of the first kind and of order O, $\beta$ is the ratio of the velocity V of the ions to that of the light and $\lambda$ is the wavelength of the field in vacuum. If x is the quantity $2\pi a/\beta\lambda$, the development in series of $I_o$ is:

$$1+(x^2/4)+(x^4/64)+\ldots$$

Therefore, the field $E_o$ on the axis is weaker than the field $E_a$ (which is on average equal to $V/\mathbf{1}_2$) and can be much weaker than said field. For example, for $\beta=0.01$, $\lambda=6$ m (f=50 MHz) and a =10 cm, we obtain $I_o\simeq\mathbf{28}$.

Figure 6:
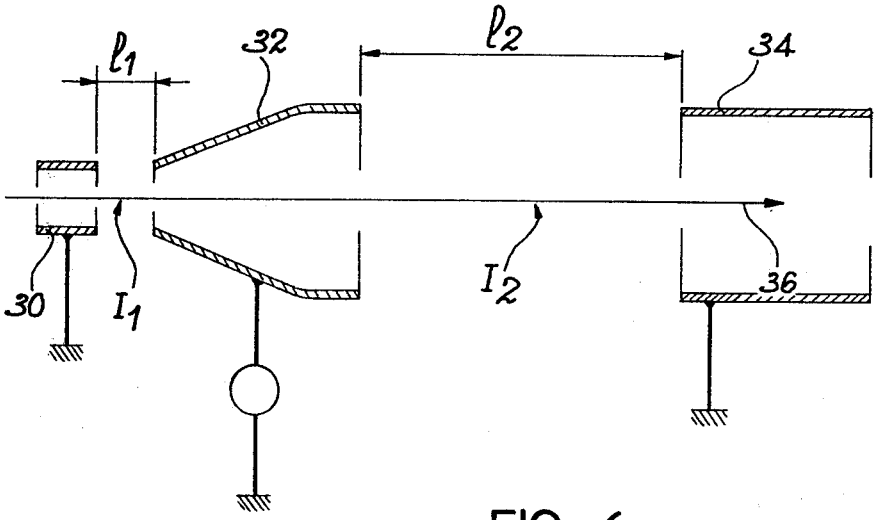
FIG. 6 diagrammatically, a buncher—debuncher resonant structure according to a third variant of the invention.

In this variant, the second gap $I_2$ plays a negligible part compared with that played by $I_1$, because the field on the axis y is much weaker than in the first gap. This part played by the gap $I_2$ can be even further reduced according to a third variant if it is lengthened in the manner shown in FIG. 6 until it has a length $\mathbf{1}_2$, which is large compared with vT. Thus, as in the variant illustrated by FIGS. 3 and 4 the field acts in directions which vary during the transit of the ions, which reduces its clearly defined action.

It is obvious that the structures described hereinbefore can be of revolution or have other configurations, parallelepipedic for example.

It is also obvious that a large variety of configurations can be used for the actual resonant cavity. It can be of the $\lambda/4$ line type, as in FIG. 4, but can also have a helical or spiral support, the latter type being illustrated in FIG. 7.

Figure 7:
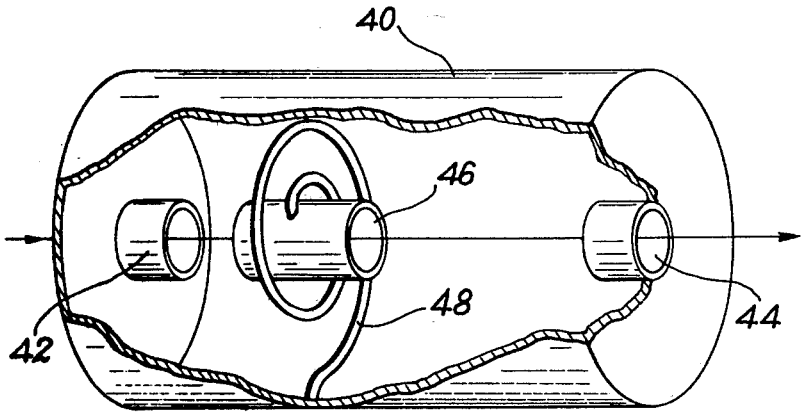
FIG. 7 a special embodiment of the buncher—debuncher construction according to the invention.

The structure shown in FIG. 7 comprises a cavity 40, supply pipe 42, discharge pipe 44, a sliding tube 46, a spiral conductor 48 forming a choke, whereby the spaces between tube 46 and pipes 42 and 44 constitute capacitive zones. This arrangement makes it possible to significantly reduce the overall dimensions of the structure.

In all these cases, the cavity can be tunable by variations to certain dimensions.

What is claimed is:

1. An ion beam buncher—debuncher of the type having a resonant structure supplied by a high frequency or hyperfrequency generator, said structure comprising a cylindrical wall closed by two lateral faces respectively traversed by a supply pipe and a discharge pipe for the beam, together with a sliding tube arranged between the said pipes and defining with the supply pipe a first gap and with the discharge pipe a second gap, the ion beam being introduced into the said structure by the supply pipe firstly undergoing in the first gap a first action on the part of the electrical field therein, then traversing the sliding tube and finally undergoing in the second gap a second action on the part of the electrical field therein and leaving the structure by the discharge pipe, wherein the supply and discharge pipes have different cross-sections, the sliding tube having a flared shape passing from a small cross-section equal to that of one of the pipes to a large cross-section equal to that of the other pipe. one of the two gaps affecting the ion beam with a substantial weaker electric field than that affected by the other gap.

2. An ion beam buncher—debuncher of the type having a resonant structure supplied by a high frequency or hyperfrequency generator, said structure comprising a cylindrical wall closed by two lateral faces respectively traversed by a supply pipe and a discharge pipe for the beam, together with a sliding tube arranged between the said pipes and defining with the supply pipe a first gap and with the discharge pipe a second gap, the ion beam being introduced into the said structure by the supply pipe firstly undergoing in the first gap a first action on the part of the electrical field therein, then traversing the sliding tube and finally undergoing in the second gap a second action on the part of the electrical field therein and leaving the structure by the discharge pipe, wherein one of said first and second gaps has a length such that it is traversed by the ion beam in a long time compared with the resonant half-cycle of the structure one of the two gaps affecting the ion beam with a substantial weaker electric field than that affected by the other gap.

* * * * *